US008627755B1

(12) United States Patent
Eckel

(10) Patent No.: US 8,627,755 B1
(45) Date of Patent: Jan. 14, 2014

(54) MUZZLE BRAKE

(76) Inventor: Don M. Eckel, Prescott, AZ (US)

( * ) Notice: Subject to any disclaimer, the term of this patent is extended or adjusted under 35 U.S.C. 154(b) by 155 days.

(21) Appl. No.: 13/233,318

(22) Filed: Sep. 15, 2011

(51) Int. Cl.
*F41A 21/28* (2006.01)

(52) U.S. Cl.
USPC ..... 89/14.3

(58) Field of Classification Search
USPC ..... 89/14.3
See application file for complete search history.

(56) References Cited

U.S. PATENT DOCUMENTS

| | | | | |
|---|---|---|---|---|
| 2,206,567 | A * | 7/1940 | Hughes | 89/14.3 |
| 3,141,376 | A * | 7/1964 | Chinn | 89/14.3 |
| 4,583,445 | A | 4/1986 | Blair | |
| 4,919,035 | A | 4/1990 | Pinkston et al. | |
| 4,930,396 | A | 6/1990 | Johnson | |
| 5,092,223 | A * | 3/1992 | Hudson | 89/14.2 |
| 5,202,530 | A | 4/1993 | Stephens | |
| 5,305,677 | A | 4/1994 | Kleinguenther et al. | |
| 5,425,298 | A | 6/1995 | Coburn | |
| 5,612,504 | A | 3/1997 | Stitt et al. | |
| 6,725,593 | B1 | 4/2004 | Harris | |
| 7,032,339 | B1 | 4/2006 | Bounds | |

* cited by examiner

*Primary Examiner* — Stephen M Johnson
(74) *Attorney, Agent, or Firm* — Cahill Glazer PLC

(57) ABSTRACT

A muzzle brake/compensator for attachment to the barrel of a firearm incorporates an expansion chamber for receiving expanding gases following a projectile exiting from the barrel of the firearm. The expanding gases in the expansion chamber are directed to strategically positioned ports in the periphery of the muzzle brake which directs the escaping expanding gases radially outwardly from the centerline of the firearm bore and inclined toward the firearm/shooter. The expansion chamber is provided with a baffle surface extending from the interior surface of a bore extension or wiper section to the port entrances of the respective ports. The angle of the baffle surface with respect to the bore centerline is limited to a range within which significant reduction in recoil force is achieved.

1 Claim, 1 Drawing Sheet

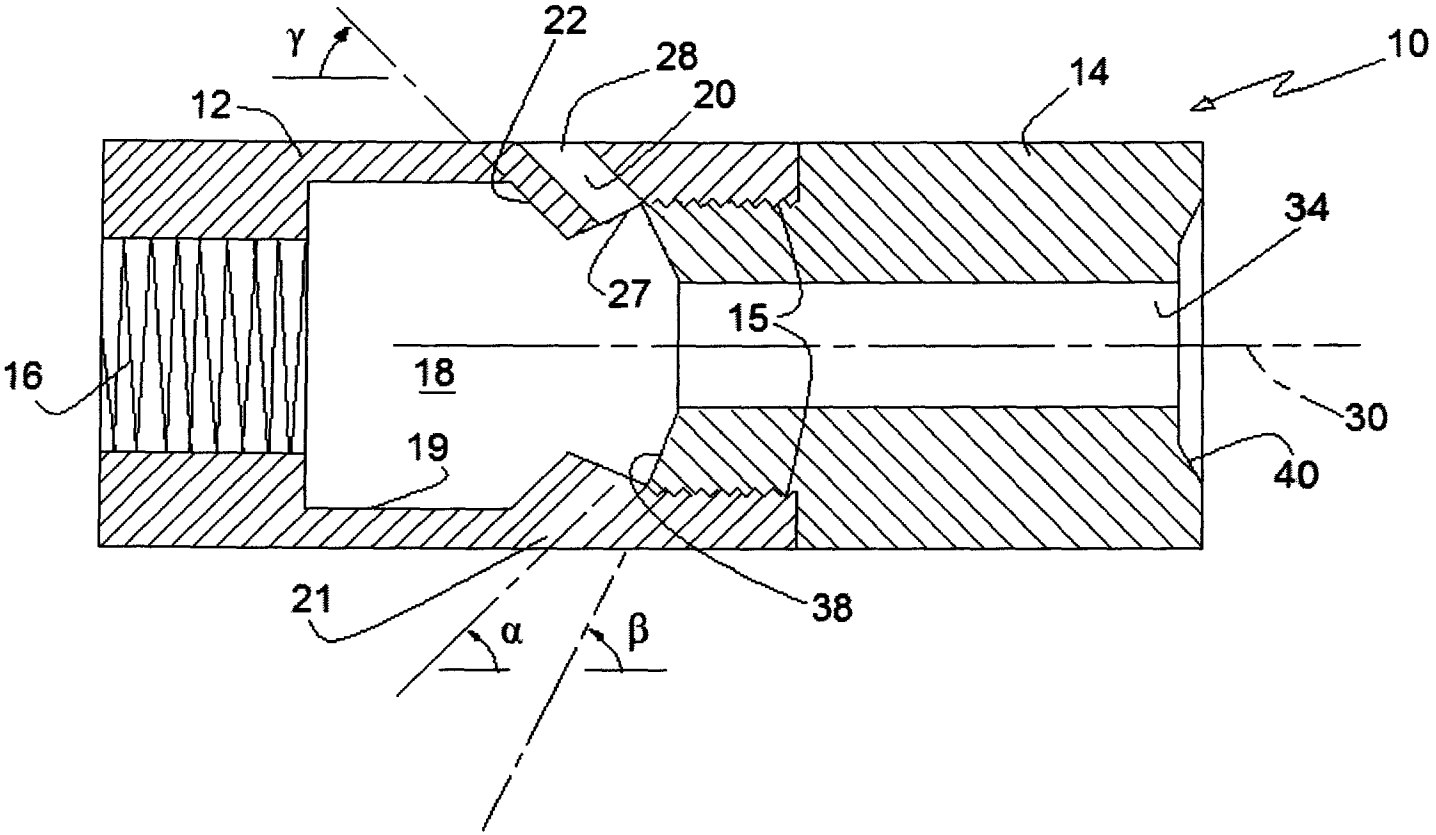
10
14
34
30
40
15
38
20
28
27
22
β
α
18
19
γ
21
12
16

MUZZLE BRAKE

FIELD OF THE INVENTION

The present invention is directed to devices to reduce recoil of a firearm when discharged, resulting from gas production, gas pressure increase, gas and projectile acceleration, and escaping high pressure gas when a firearm is discharged.

BACKGROUND OF THE INVENTION

The acceleration of a projectile in the barrel of a rifle, shotgun or handgun results in a reaction force, or recoil, imparted to the weapon and ultimately to the shooter. As the projectile is accelerated along the barrel and exits the muzzle of the weapon, high pressure gases escaping behind the projectile contribute to the recoil force. It is well known in the prior art to redirect these expanding gases as the projectile nears the muzzle; the direction of these redirected gases is generally inclined toward the weapon/shooter thus resulting in a counter-recoil force. It is well known that the reduction in recoil force may render the discharging of the firearm more pleasant for the shooter and perhaps contribute to the shooter's capability to handle and accurately discharge the firearm.

It is also well known in the prior art that the redirection of escaping gases from the bore of a firearm may be non-symmetrically directed such that ports positioned to guide escaping gases may selectively be positioned to provide a downward as well as a forward reactionary force. That is, particularly with regard to handguns, the muzzle of the gun has a tendency to rise upon a discharge thus making second or subsequent discharges difficult to be properly aimed at a target. The directing of escaping gases upwardly as well as toward the shooter may result in forces countering the "muzzle jump" to thus permit easier acquisition of target sighting for subsequent discharges.

Various designs of muzzle brakes, sometimes referred to as compensators, have been proposed in the prior art. Expanding gases are usually redirected by positioning ports communicating with the bore of the weapon to the atmosphere; therefore, as high pressure gases follow the projectile along the bore, they reach the strategically positioned ports and escape through the ports to the atmosphere. As stated previously, the axes of these ports are inclined with respect to the bore axis to provide the counter-recoil force. As the gases escape to the atmosphere, the pressure acting upon the projectile approaching the muzzle is lowered thus reducing the force that is causing the acceleration of the projectile and thus somewhat reducing the muzzle velocity. However, the design of the muzzle brake including the positioning of the ports can result in the production of counter-recoil forces that effectively reduce the recoil of the firearm upon discharge without adversely affecting the muzzle velocity of the projectile. It is therefore important that the muzzle brake design produce an effective counter recoil force without adversely affecting the velocity or accuracy of the projectile.

SUMMARY OF THE INVENTION

The present invention is directed to and incorporates a muzzle brake having an expansion chamber for receiving expanding gases delivered to the brake from the muzzle of an attached firearm. Gases from the muzzle, following a projectile passing through the expansion chamber into a wiper section, escape through ports communicating between the expansion chamber and the atmosphere. Escaping gas is directed radially outwardly from the bore centerline and inclined toward the firearm/shooter. The resulting force of the escaping redirected gases results in a counter-recoil force that lessens the effective recoil sensed by the shooter. The efficiency of the conversion of the energy of the escaping gases to create counter-recoil force is enhanced by the utilization of a baffle surface that is strategically placed with regard to incoming gases from the expansion chamber; the baffle surfaces are positioned extending radially from the bore centerline and inclined toward the firearm/shooter at a critical angle of 78°+/−5°. The expanding gases from the expansion chamber, following a projectile that is entering the wiper section of the muzzle brake is redirected by the baffle surface toward the ports which are angled with respect to the bore centerline at a lesser angle and thereby inclined toward the firearm/shooter to a greater extent than the baffle surface angle. The inclusion of the baffle surface as described has been found to increase the counter-recoil forces and lessen the felt recoil to the shooter.

BRIEF DESCRIPTION OF THE DRAWING

The present invention may more readily be described by reference to the accompanying drawing in which:

The FIGURE shown in the drawing is a cross-sectional view of a muzzle brake constructed in accordance with the teachings of the present invention.

DETAILED DESCRIPTION OF THE INVENTION

Referring to the drawing, the cross-section of a muzzle brake constructed in accordance with the teachings of the present invention is shown. For convenience in manufacture, the compensator or muzzle brake 10 is constructed in a first section 12 and a second section 14 that may be threadedly engaged 15 to form a unitary cylindrical structure. The first section 12 is internally threaded 16 for attachment to the barrel of a firearm. The cylindrical structure forming the muzzle brake 10 will normally be secured to the barrel of a firearm having the muzzle portion of the barrel externally threaded to accept the internal threading 16 of the muzzle brake. The muzzle brake thus forms a cylindrical accessory or attachment to the barrel of the firearm. The first section also includes an expansion chamber 18 wherein expanding gases following a projectile enters and subsequently escapes through strategically positioned ports. Ports 20, 21 communicate with the expansion chamber and permit escaping gases to exit from the expansion chamber through the respective port entrance 27 to the port exit 28 to atmospheric pressure. In a typical muzzle brake application, an even number of ports, such as two, four or six ports, evenly spaced about the periphery of the first section are inclined with respect to the bore centerline 30 at an angle $\alpha$ in the direction of the firearm and shooter. The angle $\alpha$ has been chosen to be in the range of 50°+/−10°. Thus, gases from the expansion chamber are redirected radially outwardly of the bore centerline and inclined at an angle toward the firearm of 50°+/−10°. The expansion chamber is bounded by the interior cylindrical surface 19 of the first section and a chamber diverter surface 22. The chamber diverter surface 22 is inclined with respect to the bore centerline at an angle $\gamma$ which, in the embodiment chosen for illustration, is 35°+/−10°.

The second section 14 threadedly engages the first section 12 to form a unitary cylindrical structure and includes a bore extension 34 sometimes referred to as a "wiper section". Unlike the rifled bore of an attached firearm, the wiper section 34 is smooth bore with a diameter slightly larger than the outside diameter of the projectile of the firearm to which the muzzle brake is attached. The diameter of the wiper section is selected as near as possible to the outside diameter of the projectile to limit the escape of high pressure gases behind the projectile as it is pushed through the wiper section 34 and specifically from escaping past the projectile between the projectile's outside diameter and the diameter of the wiper section. In this manner, the pressure behind the projectile is maintained during the projectile's travel through the wiper section (although at a reduced pressure). The pressure within the expansion chamber and behind the projectile traveling through the wiper section is therefore maintained at a higher value to thus increase the velocity and mass of the gas as it exits the respective ports. The second section 14 may also be provided with a crown 40.

It has been found that the redirection of the expanding gases is facilitated by the incorporation of a baffle surface 38 that may be machined into the surface of the second section 14 facing the expansion chamber 18. It has also been found that this baffle surface 38 is most efficient in assisting the redirection of the gases if the baffle surface extends radially from the bore centerline, inclined toward the firearm/shooter, at an angle β. This baffle surface extends from the inner surface of the wiper section, radially outwardly from the bore centerline, inclined at an angle β to terminate at the port entrances. It has been found that the incorporation of the above described baffle surface reduces recoil if the angle β is chosen at 78°+/−5°.

The specific dimensions incorporated into the metal brake of the present invention will sometimes be caliber-specific. That is, the particular dimensions of the expansion chamber such as the distance from the firearm muzzle to the entrance to the wiper section 34 (referred to as the "jump"), as well as the diameter and length of the wiper section may be dictated by the bore measurement of the firearm to which the muzzle brake is attached. Many other design parameters may be considered when reviewing the performance of a projectile and the firearm attached to the muzzle brake including such parameters as caliber, propellant charge, projectile weight, firearm barrel length, and even the pressure variations and pressure degradation as the projectile travels the length of the barrel affect the performance of the projectile. The efficiency of the muzzle brake to reduce felt recoil should minimize the affect that the muzzle brake's usage has upon the performance of the projectile. The present invention is directed to the utilization of a baffle surface 38 at an angle different from the angle of the ports and extending radially from the bore centerline at an angle of 78°+/−5°. It has been found that this angular range of the baffle surface increases the counter-recoil force and reduces felt recoil when compared to muzzle brake designs that are otherwise identical but do not have the baffle surface as described.

The following table presents chosen dimensions for a muzzle brake constructed in accordance with the teachings of the present invention and having a selected popular cartridge to derive the relevant dimensions. The chosen cartridge is 308 Winchester, or 7.62 mm NATO cartridge having a 165 grain projectile. The muzzle brake was chosen to have six ports equally spaced about the muzzle brake's periphery.

| .308 Caliber - 7.62 mm NATO | |
|---|---|
| Wiper diameter | 0.316 |
| Wiper length | 1.5 |
| Jump length | 0.9 |
| Port angle α | 40° |
| Chamber Diverter Surface angle γ | 35° |
| Baffle surface angle β | 28° |
| Overall length | 3.025 |
| Overall Diameter | 1.075 |

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed:

1. A muzzle brake for attachment to the barrel muzzle of a firearm having a bore centerline comprising:

(a) a first and a second section threadedly secured to each other to form a unitary cylindrical structure, (b) said first section including internal threads to permit the section to be threadedly secured to said barrel muzzle, and having an expansion chamber communicating with said muzzle to receive expanding gases behind a projectile exiting from said muzzle;

(c) a plurality of ports circumferentially spaced about said first section communicating with said expansion chamber to permit said expanding gases to escape to the atmosphere;

(d) said ports positioned to direct gases radially outwardly from said muzzle brake and from expansion chamber and inclined at an angle with respect to said bore centerline toward the firearm to thereby produce a counter-recoil force;

(e) a wiper section within said second section extending along the firearm bore centerline from said expansion chamber to the atmosphere to permit the passage of a projectile and expanding gases;

(f) said second section having a baffle surface extending from said wiper section to said ports; and (g) said baffle surface extending radially from the bore centerline to entrances to said ports and inclined with respect to the centerline at an angle 78°+/−5°.

* * * * *